US006080687A

United States Patent [19]

Ishwarlal

[11] Patent Number: 6,080,687

[45] Date of Patent: Jun. 27, 2000

[54] METHOD OF DYEING ANIONIC MATERIALS WITH PIGMENT COLORS HAVING A NET CATIONIC CHARGE USING A PADDING PROCESS

[75] Inventor: Ranka Ajay Ishwarlal, Gujarat, India

[73] Assignee: Zydex Industries, Gujarat, India

[21] Appl. No.: 09/274,819

[22] Filed: Mar. 18, 1999

[51] Int. Cl.[7] ..... D04H 1/64; D06P 1/44; D06P 1/66; D06P 3/60; D06P 5/02

[52] U.S. Cl. ..... 442/153; 8/551; 8/554; 8/606; 8/637.1; 8/495; 427/389.9; 427/412

[58] Field of Search ..... 8/606, 531–554, 8/637.1, 495; 427/389.9, 412; 442/153

[56] References Cited

U.S. PATENT DOCUMENTS

| | | |
|---|---|---|
| 3,446,569 | 5/1969 | Braun et al. . |
| 5,024,674 | 6/1991 | Prelini et al. . |
| 5,312,863 | 5/1994 | Van Rheenen et al. . |
| 5,330,540 | 7/1994 | McBride et al. . |
| 5,478,361 | 12/1995 | Sumii et al. . |
| 5,731,280 | 3/1998 | Nielson et al. . |

FOREIGN PATENT DOCUMENTS

| | | |
|---|---|---|
| 0 216 681 A1 | 1/1987 | European Pat. Off. . |
| 44 10 866 A1 | 5/1995 | Germany . |

*Primary Examiner*—Margaret Einsmann
*Attorney, Agent, or Firm*—Alston & Bird LLP

[57] ABSTRACT

The present invention is directed to a method for dyeing anionic textile materials such as cellulosic materials with a cationic pigment dispersion. The method comprises padding the textile material with a cationic pigment dispersion comprising a pigment and a cationic dispersant and padding the textile material with a film-forming polymer. The padding steps can occur simultaneously with both the cationic pigment dispersion and the film-forming polymer in the same bath or in consecutive padding steps with the cationic pigment dispersion applied before the film-forming polymer or vice versa. The padded materials are dried and cured to produce the pigment-dyed materials.

29 Claims, No Drawings

METHOD OF DYEING ANIONIC MATERIALS WITH PIGMENT COLORS HAVING A NET CATIONIC CHARGE USING A PADDING PROCESS

FIELD OF THE INVENTION

The present invention relates to a process for dyeing anionic textile materials using padding methods. More particularly, the present invention relates to a process for applying pigment colours having a net cationic charge to cellulosic fabrics.

BACKGROUND OF THE INVENTION

The pigment dyeing of cellulosic textile materials is well known. The conventional process for dyeing cellulosic textile materials comprises padding these materials with a bath containing anionic or neutral pigment colour dispersions, an anionic binder, a latent acid-liberating catalyst, a crosslinking agent, an anti-migrating agent, and other additives. The textile materials are then dried at about 100° C. and then further heated at 150° C. for about 5 minutes to cure the pigment colours and film-forming binders on the textiles.

There are numerous problems associated with the conventional method of dyeing cellulosic materials. For example, because the cellulosic surface has a uniform negative charge and the pigment dispersions commercially available are also anionic in nature, there is repulsion between the pigment particles and the cellulosic surface during the padding operation. This leads ultimately to light shades along with poor leveling on the cellulosic materials even when these materials are padded from a bath containing a high concentration of pigment dispersions. For this reason, it is difficult to dye the cellulosic materials in dark shades.

In addition to these problems, there are other disadvantages in using the conventional process for dyeing cellulosic materials. For instance, the colours often thermomigrate to one side of the textile thereby producing poor leveling of the shade. Moreover, the dry and wet crock fastness and the washing fastness of the pigment-dyed cellulosic materials are generally poor. Therefore, there is a need in the art to provide a method of pigment dyeing cellulosic materials and other anionic textile materials that overcomes these problems.

SUMMARY OF THE INVENTION

The present invention provides a method for dyeing anionic materials such as cellulosic materials by padding these materials with cationic pigment dispersions. The method of the present invention produces pigment colours on anionic cellulosic textiles having excellent fastness and leveling of shade with little or no thermomigration of the pigments. In addition, the method of the invention can produce light to deep shades in the cellulosic materials. The method of the present invention also allows various types of binders to be used to dye the cellulosic fabrics with the cationic pigment dyes.

The present invention achieves these and other benefits by providing a method for dyeing anionic materials such as cellulosic materials with a cationic pigment dispersion having a net positive charge and a film-forming polymer having a positive, negative or neutral charge by Pad-Dry-Cure or Pad-Dry-Pad-Dry-Cure techniques to obtain excellent pigment-dyed cellulosic materials. The method of the present invention allows cationic polymers having surface-active properties to be prepared as dispersants and used with other additives to make a stable cationic pigment dispersion in water using commercially available pigment powders. These novel pigment dispersions have a net positive charge thereby rendering them exhaustible to the anionic surface.

The method for dyeing anionic textile materials according to the invention comprises applying a film-forming polymer and a cationic pigment dispersion comprising at least one pigment and at least one cationic dispersant to the surface of an anionic textile material typically using one or more padding steps. The textile material is then dried and the film-forming polymer cured to form the pigment-dyed textile material. Preferably, the anionic textile material is a cellulosic material including fibers selected from the group consisting of cotton, rayon, and solvent spun cellulose (e.g. Tencel®) fibers, and blends thereof. The cellulosic material can also be a blend of these cellulosic fibers and non-cellulosic fibers.

The anionic textile material can be dyed after wetting the textile material or can be dyed as a dry textile. In addition to applying the film-forming polymer and the cationic pigment dispersion to the surface of the textile, other additives can be applied to the surface of the textile. For example, additives selected from the group consisting of wetting agents, cationic or non-ionic surface-active agents, defoamers, solvents, biocides, and fungicides, can be applied to the surface of the textile material typically by adding the additives to the bath comprising the cationic pigment dispersion or the bath comprising the film-forming polymer (if applied in different padding steps), or both. The drying and curing steps can occur in the same step or separate steps at a temperature between room temperature and 300°, preferably, between 100° C. to 150° C. The padding steps are preferably performed in a mangle at a wet pick-up ranging from 10% to 300%. In addition, the padding steps are preferably conducted using a bath temperature between 0° C. and 100° C.

The cationic pigment dispersion used in accordance with the invention includes at least one pigment and at least one cationic dispersant, and can further include at least one non-ionic dispersant. The cationic dispersants used in the invention are preferably monomeric or polymeric compounds that include at least one cationic group selected from the group consisting of tertiary amines, quaternary amines, sulfonium moieties and phosphonium moieties.

In one embodiment of the invention, the method comprises padding a cellulosic material with a bath comprising water, at least one cationic pigment dispersion, and at least one cationic or neutrally-charged binder. The padded cellulosic material is then dried and cured preferably at a temperature between 100° C. to 150° C. to produce the pigment-dyed cellulosic material.

In another embodiment of the invention, the method comprises padding a cellulosic material with a bath comprising water and at least one cationic pigment dispersion and then drying the cellulosic material preferably at a temperature between 100° C. to 150° C. The cellulosic material is then padded with a bath comprising at least one binder having a positive, negative or neutral charge and then dried and cured preferably at a temperature between 100° C. to 150° C. to produce the pigment-dyed cellulosic material.

In yet another embodiment of the invention, the method comprises padding a cellulosic material with a bath comprising at least one binder having a positive, negative or neutral charge and then drying the cellulosic material preferably at a temperature between 100° C. to 150° C. The cellulosic material is then padded with a bath comprising water and at least one cationic pigment dispersion and then dried and cured preferably at a temperature between 100° C. to 150° C. to produce the pigment-dyed cellulosic material.

These and other features of the present invention will become more readily apparent to those skilled in the art upon consideration of the following detailed description that describes both the preferred and alternative embodiments of the invention.

DETAILED DESCRIPTION OF THE INVENTION

The present invention now will be described more fully hereinafter. The present invention may, however, be embodied in many different forms and should not be construed as limited to the embodiments set forth herein; rather, these embodiments are provided so that this disclosure will be thorough and complete, and will fully convey the scope of the invention to those skilled in the art. The term "comprising" as used herein is used synonymously with the term "including" and is an open, non-limiting term.

The present invention provides a process for dyeing anionic textile materials such as cellulosic materials with a cationic pigment dispersion by padding the anionic textile material with a dyeing formulation including a cationic pigment dispersion having a net positive charge and padding the anionic textile material with a formulation including a film-forming polymer. The padding steps provide a method of applying the cationic pigment dispersion and the film-forming polymer to the surface of the anionic textile material. The padding steps can occur simultaneously in one padding step using a bath comprising both the cationic pigment dispersion and the film-forming polymer and this method is particularly preferred when the film-forming polymer is cationic or non-ionic (neutral) in nature. Typically, a Pad-Dry-Cure sequence is used to simultaneously apply the cationic pigment dispersion and film-forming polymer.

In addition to this method, the film-forming polymer can also be applied in a separate padding step either before or after the cationic pigment dispersion is applied to the textile material. This method can be used for cationic, non-ionic, or anionic film-forming polymers. Typically, a Pad-Dry-Pad-Dry-Cure sequence is used to apply the film-forming polymer and the cationic pigment dispersion in separate padding steps with a drying step in between to dry the formulation on the surface of the anionic textile material.

The anionic textile materials that are dyed in accordance with the invention can be in any textile form that can be dyed using a padding process. The term "anionic textile material" as used herein includes textiles that can be dyed using a padding process (e.g. fabrics) and includes not only textile materials that consist essentially of anionic fibers or filaments but also to textile materials that are blends of anionic fibers or filaments and cationic or non-ionic fibers or filaments. Preferably, the anionic textile materials of the invention are cellulosic materials. The term "cellulosic material" as used herein includes not only materials consisting essentially of cellulosic fibers but also materials that include blends of cellulosic fibers and non-cellulosic fibers. Exemplary cellulosic fibers included in the cellulosic materials used with the invention include cotton, rayon, solvent spun cellulose (e.g. Tencel®), flax (linen), acetate, jute, abaca, coir, hemp, kapok, pina, sisal, and ramie fibers, and blends thereof. The cellulosic material can also be a blend of these cellulosic fibers and non-cellulosic fibers or filaments, e.g., cotton and polyester blends.

As described above, because pigments generally have an anionic surface (i.e. have a net negative charge), it is the common practice in the art that these anionic pigments are combined with non-ionic and anionic dispersants to form pigment dispersions that are used in dyeing. In accordance with the present invention, however, cationic pigment dispersions are prepared from these pigments. These cationic pigment dispersions include at least one pigment and at least one cationic dispersant. Exemplary pigments include Permanent Yellow DHG, Permanent Yellow GR, Permanent Yellow PG, Permanent Orange G, Permanent Red FGR, Permanent Red F4R 1747, Permanent Bordeaux FRR, Hostaperm Blue CBR, Hostaperm Blue BG-JD, Hostaperm Violet RL SPL, Hostaperm Green GNX-D (available from Color Chem Ltd.), titanium dioxide and carbon black.

The cationic dispersant used in the invention preferably has a high density of cationic groups to produce a net positively charged pigment dispersion. In addition, the cationic dispersant preferably has good adsorption to the pigment surface so that the dispersion remains stable and positively charged even when diluted. The cationic pigment dispersion is also preferably stable in high shear conditions. Any cationic surface-active molecule having the above properties can be used in accordance with the invention. Exemplary compounds include water-soluble, monomeric or polymeric compounds that include at least one cationic group selected from the group consisting of tertiary amines, quaternary amines, sulfonium moieties and phosphonium moieties. However, monomeric or polymeric compounds can also be used that include other cationic groups that possess the properties described above. Preferably, cationic emulsifiers that include tertiary amines, quaternary amines, sulfonium moieties or phosphonium moieties are used as cationic dispersants in the invention. Exemplary cationic dispersants include dimethyldicoco ammonium chloride, trimethyl tallow ammonium chloride, N-tallow pentamethyl propane diammonium chloride, polyoxyalkylene quaternary amine, N-cetyl, N-ethyl morpholinium ethosulfate, and polypropoxy quaternary ammonium chloride.

The cationic dispersants are mixed with water for use in the invention. The cationic dispersant are then mixed with pigments that are typically in powder form. In addition, at least one non-ionic dispersant can be added to the mixture. The mixture is ground in a conventional pigment dispersion mill and then mixed with water to produce a stable aqueous dispersion having a net positive charge to achieve a desired concentration of pigment. Additives such as wetting agents, cationic or non-ionic surface-active agents, defoamers, solvents, biocides, fungicides, and the like, can be added to the dispersion to provide desired properties.

The film-forming polymers (binders) used in accordance with the invention can be cationic, non-ionic or anionic. Film-forming polymers are preferably selected that can bind the pigment to the surface of the anionic textile material. Exemplary film-forming polymers include acrylic polymer, epoxy polymers, urethane polymers, polyester polymers, and the like. The cationic film-forming polymers include at least one cationic group such as a cationic group selected from the group consisting of tertiary amines, quaternary amines, sulfonium moieties, and phosphonium moieties. The anionic film-forming polymers include anionic groups such as carboxyls, sulfonates, and the like. The non-ionic film-forming polymers include non-ionic groups. The film-forming polymers used in the invention are typically in the form of water-based dispersions. These dispersions are stable when subjected to the shearing conditions in the diluted condition of the padding bath.

The cationic pigment dispersions and film-forming polymers described above are used in padding baths to dye the anionic textile materials. A stock solution is prepared by mixing the pigment colour dispersions, the film-forming polymer dispersions or both together in water with additives such as those described above along with softeners, crosslinking agents, and the like. These constituents can be combined in any order to produce the padding bath. Based on the desired wet pick-up, the concentrations of the pigment colour dispersion and the film-forming polymer dispersion can be adjusted by adjusting the quantity of water.

When the film-forming polymer is cationic or non-ionic, a Pad-Dry-Cure technique is then preferably used to produce the dyed textile material. In this process, the film-forming polymer dispersion and cationic pigment dispersion are mixed in the same dye bath and dyed in a single padding step. The textile is then dried and cured to produce the pigment-dyed textile material.

When the film-forming polymer is anionic, a Pad-Dry-Pad-Dry-Cure technique is used with the cationic pigment dispersion and film-forming polymer dispersion kept in different baths. This technique can also be used with cationic or non-ionic film-forming polymers. In the Pad-Dry-Pad-Dry-Cure technique, the textile is padded first with the bath containing the cationic pigment dispersion, dried, and then padded with the bath containing the film-forming polymer dispersion, or the process can be reversed. After the second padding step, the textile material is dried and cured to produce the pigment-dyed textile material.

As understood to those skilled in the art of pad dyeing techniques, the anionic textile material is padded by preparing a padding bath solution as described above and this bath solution is added either fully or in part to the trough of a padding mangle. The temperature of the bath is preferably between 0° C. and 100° C. and the bath is adjusted to have a wet pick-up between 10% and 300%. After the rollers of the padding mangle are adjusted to the desired pressure level, the anionic textile material is passed through the bath solution in the trough and then squeezed by passing through the rollers of the padding mangle. The anionic textile material can either be dyed in dry condition or wet textiles having uniform water content (in a wet-on-wet treatment) can be passed through the first padding bath. When a second padding bath is used such as in Pad-Dry-Pad-Dry-Cure techniques, the textile is in a dry condition when passed through the padding mangle.

Once the anionic textile material passes through the mangle and is squeezed by the rollers, the anionic textile material is dried and cured to bind the film-forming polymer and pigment to the surface of the textile materials. The drying and curing can be performed in two steps or in a single step. The textile material can be dried and cured at between room temperature (e.g. 20–25° C.) and 300° C. Preferably, the drying and curing steps occur at an elevated temperature between 100° C. and 150° C.

The dyeing method of the invention produces anionic textile materials and in particular cellulosic textile materials with bright, uniform and solid dark shades with low levels of colour migration. Also, there is excellent leveling of pigment colours and dry and wet crock and washing fastness. The feel of the dyed textile materials is also soft.

Although the method of dyeing anionic textile materials with cationic pigment colours according to the invention is described in particularity above, this method can be varied such as by changing the sequencing or by changing parameters such as concentration, temperature, time, pH, percent wet pick-up, to achieve the same benefits described herein. Moreover, there is no restriction on the sequence of bleaching and other operations prior to dyeing to produce these benefits.

The present invention will now be further described by the following non-limiting examples. All parts and percentages are by weight except where otherwise indicated.

EXAMPLE 1

A cationic grind resin was prepared by charging a 1 liter, 4-neck reactor kettle fitted with an agitator, reflux condenser and a thermometer with 70 grams of ethyl CELLOSOLVE™® [ethylene glycol monoethyl ether available from Union Carbide] and 3 grams of azobisisobutyronitrile (AIBN). The temperature was raised to 105° C. and 202 grams of butyl acrylate and 303 grams of dimethylamino ethylmethcrylate were slowly added over the next three hours. Then, 343 grams of ethyl CELLOSOLVE™ and 7 grams of dissolved AIBN were also simultaneously added over a three hour period. The reactor kettle was cooled as needed during the reaction period. The polymer solution was held at 105° C. for an additional 2 hours. The reactor was cooled to 50° C. and 194 grams of dimethyl sulfate was added. The temperature was maintained at 70° C. for 1 hour. A vacuum was applied and 240–250 grams of the ethyl CELLOSOLVE™ was removed. Then, 700 grams of demineralized water and 19.8 grams of epichlorohydrin were added. The reactor was held at 70° C. for 2 hours and the cationic polymer resin discharged.

EXAMPLE 2

Pigment dispersions were prepared using the formulations shown in Table 1 by grinding them for two hours in an Atritor pigment mill with 2–3 mm glass beads until a finish of Hegman gauge of minimum 7 was achieved.

Phase (A) was mixed together with the cationic resin and additives forming the cationic dispersant. Phase (A) was stirred at low speed while adding phase (B). The stirrer speed was increased and after 1.5 hours, phase (C) was added and the mixture stirred for another 30 minutes. The pigment dispersion was then filtered and stored.

TABLE I

| | Quantity in grams | | | | | |
|---|---|---|---|---|---|---|
| Name of the Ingredients | Red F4R | Blue BGID | Yellow | Green | Orange | Carbon Black |
| (A) | | | | | | |
| Cationic Resin[1] | 4.00 | 5.00 | 5.00 | 5.00 | 5.00 | 5.00 |
| Defoamer | 1.50 | 1.50 | 1.50 | 1.50 | 1.50 | 1.50 |
| Biocide | 0.10 | 0.10 | 0.10 | 0.10 | 0.10 | 0.10 |
| Water[2] | 47.00 | 48.25 | 48.25 | 48.25 | 48.25 | 48.25 |
| Additive[3] | 1.00 | 1.00 | 1.00 | 1.00 | 1.00 | 1.00 |
| Additive[4] | 8.00 | 8.00 | 8.00 | 8.00 | 8.00 | 8.00 |
| Additive[5] | 2.00 | 2.00 | 2.00 | 2.00 | 2.00 | 2.00 |
| Additive[6] | 0.50 | 0.50 | 0.50 | 0.50 | 0.50 | 0.50 |
| Glass Beads | 137.50 | 137.50 | 137.50 | 137.50 | 137.50 | 137.50 |
| (B) | | | | | | |
| Pigment | 15.00 | 20.00 | 20.00 | 20.00 | 20.00 | 20.00 |
| (C) | | | | | | |
| Resin[1] | 1.00 | 1.25 | 1.25 | 1.25 | 1.25 | 1.25 |
| Water[2] | 19.90 | 12.40 | 12.40 | 12.40 | 12.40 | 12.40 |
| | 237.50 | 237.50 | 237.50 | 237.50 | 237.50 | 237.50 |

[1]Cationic resin from Example 1
[2]Demineralized water
[3]10 moles of the ethylene oxide of nonylphenol
[4]15–18 moles of the ethylene oxide of nonylphenol - 50% in demineralized water
[5]Dilauryl polyethylene glycol (1500) - 50% in demineralized water
[6]2.5 moles of the ethylene oxide of nonylphenol

EXAMPLE 3

A seed binder for a film-forming binder having a net positive charge was prepared as follows:

a) To a 1-liter glass kettle with a 4 neck lid and fitted with an agitator, a thermometer, and a reflux condenser, 318 grams of demineralized water and 0.75 grams of 20 moles of the ethylene oxide of nonylphenol was added. The reactor was then heated to 78° C.

b) Separately, 2 grams of benzoyl peroxide was dissolved in 250 grams of butyl acrylate.

c) Also separately, 12.5 grams of dimethylamino ethyl methacrylate was added to 125 grams of demineralized water and heated to 80° C. Then, 18 grams of epichlorohydrin was added and heating continued for 1.5 hours thereby forming a clear solution. Then, 180 grams of water with 40 grams of 20 moles of the ethylene oxide of nonylphenol and 2.80 grams of 48% N-methylol acrylamide were added.

d) The butyl acrylate and benzoyl peroxide solution (b) was added slowly to the aqueous solution (c) to form a stable emulsion. Fifteen grams of demineralized water with 2 grams of ammonium persulfate was added to the reactor (from step (a)) and held at 78° C. for 20 minutes. The emulsion was then added to the reactor over 3 hours at 90° C. and the reaction was held for 2 hours. The product was filtered. The product was fluid and white in colour and coagulum free.

EXAMPLE 4

A film-forming binder with a net positive charge was prepared as follows:

To a 1-liter glass kettle with a 4-neck lid and fitted with an agitator, a thermometer and a reflux condenser, 290 grams of demineralized water and 1.87 grams of 20 moles of the ethylene oxide of nonylphenol were added. The reactor was heated to 90° C. and 25 grams of water with 1.5 grams of ammonium persulfate was added with 1.87 grams of the binder from Example 3 and 30 grams of demineralized water.

Then, 12.5 grams of dimethylamino ethylmethacrylate was added to 125 grams of demineralized water and heated to 80° C. and 18 grams of epichlorohydrin was added to this mixture and maintained for 1 hour until the monomer was completely dissolved. To this, 94 grams of water was added followed by 13.13 grams of 20 moles of the ethylene oxide of nonylphenol.

70 grams of Luxsil® emulsifier (a cationic dispersant available from Zydex Industries) was dissolved in 35 grams of acetic acid and 10 grams of the resin from Example 1 and added to the aqueous monomer solution. After mixing thoroughly, 152.4 grams of butyl acrylate, 55 grams of styrene, 2.09 grams of benzoyl peroxide and 2.0 grams of hydroxyethyl methacrylate were added. The emulsion produced was then added to the reactor over 3 hours at 90° C. The reactor was held at 90° C. for 2 hours to complete the reaction and then cooled to room temperature. The product was free of coagulam, filtered and ready for use.

EXAMPLE 5

A film-forming binder with a net positive charge was prepared as follows:

To a 1-liter glass kettle with a 4-neck lid and fitted with an agitator, a thermometer and a reflux condenser, 290 grams of demineralized water and 1.87 grams of 20 moles of the ethylene oxide of nonylphenol were added. The reactor was heated to 90° C. and 25 grams of water with 1.5 grams of ammonium persulfate was added with 1.87 grams of the binder from Example 4 and 30 grams of demineralized water.

Then, 12.5 grams of dimethylamino ethyl methacrylate was added to 125 grams of demineralized water and heated to 80° C. and 18 grams of epichlorohydrin was added to this mixture and maintained for 1 hour until the monomer completely dissolved. To this, 94 grams of water was added followed by 13.13 grams of 20 moles of the ethylene oxide of nonylphenol and 35 grams of 48% N-methylol acrylamide. Ten grams of the resin from Example 1 was added to this aqueous monomer solution.

After mixing thoroughly, 152.4 grams of butyl acrylate, 55 grams of styrene, 2.09 grams of benzoyl peroxide and 2.0 grams of hydroxyethyl methacrylate were added. The emulsion produced was then added to a reactor over 3 hours at 90° C. After one and half hours of addition, 0.35 grams of tertiary butyl hydro peroxide with 10 grams of water was added followed by 1.42 grams of sodium formaldehyde sulfoxylate dissolved in 20 grams of demineralized water over the next 1.5 hours. The reactor was held at 90° C. for 2 hours to complete the reaction and then cooled to room temperature. The product was free of coagulam, filtered and ready for use.

EXAMPLE 6

An anionic grind resin was prepared by charging a 1 liter, 4-neck reactor kettle fitted with an agitator, a reflux condenser and a thermometer with 70 grams of ethyl CELLOSOLVE™ and 1.5 grams of azobisisobutyronitrile (AIBN). The temperature was raised to 105° C. and 294 grams of butyl acrylate, 73.5 grams of styrene, 122.5 grams of acrylic acid, and 7.4 grams of dimethylamino ethylmethcrylate were slowly added over the next three hours. 343 grams of ethyl CELLOSOLVE™ with 4.5 grams of dissolved AIBN was also simultaneously added over a three hour period. The reactor kettle was cooled as needed during the reaction period. The polymer solution was held at 105° C. for an additional 2 hours. The temperature was maintained at 70° C. for 1 hour. A vacuum was applied and 380 grams of ethyl CELLOSOLVE™ was removed. Then, 300 grams of demineralized water, 310 grams of monoethylene glycol and 122.5 grams of dimethyl ethanol amine were added over 30 minutes at 70° C. The mixture was stirred further for 30 minutes and an anionic polymer resin was discharged.

EXAMPLE 7

Pigment dispersions were prepared using the formulations shown in Table II by grinding them for two hours in an Atritor pigment mill with 2–3 mm glass beads until a finish of Hegman gauge of minimum 7 was achieved.

Phase (A) was mixed together with the anionic resin and additives forming the anionic dispersant. Phase (A) was stirred at low speed while adding phase (B). The stirrer speed was increased and after 1.5 hours, phase (C) was added and stirred for another 30 minutes. The pigment dispersion was then filtered and stored.

TABLE II

| | Quantity in grams | | | | | |
|---|---|---|---|---|---|---|
| Name of the Ingredients | Red F4R | Blue BGID | Yellow | Green | Orange | Carbon Black |
| (A) | | | | | | |
| Anionic Resin[1] | 4.00 | 5.00 | 5.00 | 5.00 | 5.00 | 5.00 |
| Defoamer | 1.50 | 1.50 | 1.50 | 1.50 | 1.50 | 1.50 |
| Biocide | 0.10 | 0.10 | 0.10 | 0.10 | 0.10 | 0.10 |
| Water[2] | 47.00 | 48.25 | 48.25 | 48.25 | 48.25 | 48.25 |
| Additive[3] | 1.00 | 1.00 | 1.00 | 1.00 | 1.00 | 1.00 |
| Additive[4] | 8.00 | 8.00 | 8.00 | 8.00 | 8.00 | 8.00 |
| Additive[5] | 2.00 | 2.00 | 2.00 | 2.00 | 2.00 | 2.00 |
| Additive[6] | 0.50 | 0.50 | 0.50 | 0.50 | 0.50 | 0.50 |
| Glass Beads | 137.50 | 137.50 | 137.50 | 137.50 | 137.50 | 137.50 |

TABLE II-continued

| | Quantity in grams | | | | | |
|---|---|---|---|---|---|---|
| Name of the Ingredients | Red F4R | Blue BGID | Yellow | Green | Orange | Carbon Black |
| (B) | | | | | | |
| Pigment | 15.00 | 20.00 | 20.00 | 20.00 | 20.00 | 20.00 |
| (C) | | | | | | |
| Resin[1] | 1.00 | 1.25 | 1.25 | 1.25 | 1.25 | 1.25 |
| Water[2] | 19.90 | 12.40 | 12.40 | 12.40 | 12.40 | 12.40 |
| | 237.50 | 237.50 | 237.50 | 237.50 | 237.50 | 237.50 |

[1]Anionic resin from Example 6
[2]Demineralized water
[3]10 moles of the ethylene oxide of nonylphenol
[4]15–18 moles of the ethylene oxide of nonylphenol - 50% in demineralized water
[5]Dilauryl polyethylene glycol (1500) - 50% in demineralized water
[6]2.5 moles of the ethylene oxide of nonylphenol The following examples show how these formulations can be used in a padding method to pigment dye anionic cellulosic textiles in accordance with the invention.

EXAMPLE 8

A Pad-Dry-Pad-Dry-Cure sequence was selected for the cationic pigment dyeing method of the invention and a Pad-Dry-Cure sequence was selected for the conventional method of anionic pigment dyeing.

Cationic Pigment Dyeing

The first bath was prepared as follows:

Ten grams of a cationic pigment dispersion from Example 2 and 90 grams of water were combined to make 10% solution and a knitted cotton fabric having good absorbency was padded using this dye bath at 80% wet pick up. The padded fabric was completely dried at 100° C.

The second bath was prepared using the following:

| Name of the Ingredients | Quantity (grams) |
|---|---|
| Binder from Example 4 | 15 |
| Urea | 2 |
| Melamine Resin | 1 |
| Amino Silicone (30%) | 1 |
| Ammonium Chloride | 1 |
| Water | 80 |

The fabric padded with the cationic pigment was padded using this prepared binder bath at 80% wet pick up. The padded fabric was completely dried at 100° C. and cured at 150° C. for 5 minutes. Red F4R, Blue BGID, Black and Green pigment dispersions were prepared using this pad dyeing method. The results are summarized in Table III.

Anionic Pigment Dyeing (a) A commercially available anionic pigment dispersion having a 10% concentration and an anionic commercial binder (Z-7000® from Zydex Industries) were combined with other additives as follows to produce the dye bath as per the following recipe.

| Name of the Ingredients | Quantity (grams) |
|---|---|
| Anionic Binder (Z-7000) | 15 |
| Urea | 2 |
| Melamine Resin | 1 |
| Amino Silicone (30%) | 1 |
| Ammonium Chloride | 1 |
| Anionic Pigment Dispersion (commercially available) | 10 |
| Water | 70 |

Red, Blue, Green and Black pigment dispersions using these constituents were prepared.

A knitted cotton fabric having a good absorbency was padded using the prepared dye bath at 80% set pick-up. The padded fabric was completely dried at 100° C. and cured at 150° C. for 5 minutes.

(b) The anionic dispersions prepared from Example 7 were combined with other additives as follows to produce the dye bath:

| Name of the Ingredients | Quantity (grams) |
|---|---|
| Anionic Binder (Z-7000) | 15 |
| Urea | 2 |
| Melamine Resin | 1 |
| Amino Silicone (30%) | 1 |
| Ammonium Chloride | 1 |
| Anionic Pigment Dispersion (Example 7) | 10 |
| Water | 70 |

This formulation was used to prepare Red F4R, Blue BGID, Green and Black pigment dispersions for pad dyeing.

A knitted cotton fabric having good absorbency was padded using this prepared dye bath at 80% wet pick-up. The padded fabric was completely dried at 100° C. and cured at 150° C. for 5 minutes.

TABLE III

| | Leveling | Wet Rubbing Fastness | Dry Rubbing Fastness | Feel | Washing Fastness | Thermo Migra-tion | Colour Value |
|---|---|---|---|---|---|---|---|
| Cationic Pigment Dispersion (Example 2) (15–20% Conc.) | | | | | | | |
| RED F4R | 4–5 | 4 | 3–4 | 5 | 4–5 | 5 | Medium |
| BLUE BGID | 5 | 4–5 | 3 | 5 | 4 | 5 | Dark |
| BLACK | 4 | 3 | 3 | 4–5 | 4 | 5 | Dark |
| GREEN | 5 | 4–5 | 3–4 | 5 | 4–5 | 5 | Medium |
| Commercial Pigment | | | | | | | |
| RED | 4 | 4 | 3–4 | 3 | 3–4 | 5 | Dark |
| BLUE | 3 | 3–4 | 3–4 | 3 | 3–4 | 2 | Dark |
| BLACK | 3 | 2 | 2 | 3 | 3–4 | 2–3 | Light |
| GREEN | 2–3 | 4–5 | 4–5 | 2–3 | 3 | 2 | Dark |
| Anionic Pigment Dispersion (Example 7) (15–20% Conc.) | | | | | | | |
| RED F4R | 4 | 4–5 | 3–4 | 4 | 4–5 | 3–4 | Light |
| BLUE BGID | 2–3 | 4–5 | 2–3 | 4 | 4–5 | 2–3 | Light |
| BLACK | 3 | 4–5 | 3–4 | 4–5 | 4 | 2–3 | Light |
| GREEN | 4–5 | 4–5 | 2–3 | 4–5 | 4–5 | 2 | Light |

*Commercial pigments typically have 30–35% pigment concentration by weight

A rating of 1 to 5 was given for each category representing poor and 5 representing excellent.

Table III shows the superiority of the padding process of the invention using cationic pigment dispersions in most of the above properties.

EXAMPLE 9

100% cotton woven fabric was dyed using the procedures described in Example 8 at a wet pick up of 65%. The results are summarized in Table IV:

TABLE IV

| | Leveling | Wet Rubbing Fastness | Dry Rubbing Fastness | Feel | Washing Fastness | Thermo Migra-tion | Colour Value |
|---|---|---|---|---|---|---|---|
| Cationic Pigment Dispersion (15–20% Conc.) | | | | | | | |
| RED F4R | 4–5 | 3 | 4 | 3–4 | 3–4 | 4–5 | Medium |
| BLUE BGID | 4–5 | 8 | 8 | 4 | 3–4 | 4–5 | Dark |
| BLACK | 4–5 | 2 | 4 | 4–5 | 4 | 4–5 | Dark |
| GREEN | 4–5 | 3–4 | 4–5 | 4 | 3–4 | 4–5 | Medium |
| Commercial Pigment (30–35% Conc.) | | | | | | | |
| RED | 3–4 | 1–2 | 3–4 | 2 | 3 | 2–3 | Dark |
| BLUE | 2–3 | 1–2 | 2 | 1–2 | 3–4 | 3 | Dark |
| BLACK | 2–3 | 3 | 4–5 | 2 | 4 | 2–3 | Medium |
| GREEN | 2–3 | 3 | 4 | 2 | 3–4 | 2 | Dark |
| Anionic Pigment Dispersion (15–20% Conc.) | | | | | | | |
| RED F4R | 3 | 4 | 4–5 | 1–2 | 4 | 2–3 | Light |
| BLUE BGID | 3 | 4 | 4 | 2–3 | 2–3 | 2 | Light |
| BLACK | 3–4 | 4 | 5 | 2–3 | 4 | 2–3 | Medium |
| GREEN | 2–3 | 4 | 5 | 2–3 | 4 | 2 | Light |

A rating 1 to 5 was given with 1 representing poor and 5 representing excellent.

Table IV shows the superiority of the padding process of the invention using with cationic pigment dispersions.

EXAMPLE 10

A polyester:cotton (67:33) blend woven fabric was dyed according to the procedure described in Example 8 at a wet pick up of 52%. The results are summarized in Table V:

TABLE V

| | Leveling | Wet Rubbing Fastness | Dry Rubbing Fastness | Feel | Washing Fastness | Thermo Migra-tion | Colour Value |
|---|---|---|---|---|---|---|---|
| Cationic Pigment Dispersion (15–20% Conc.) | | | | | | | |
| RED F4R | 3–4 | 3 | 2–3 | 4 | 3–4 | 2–3 | Medium |
| BLUE BGID | 3 | 3 | 3 | 4–5 | 3–4 | 4 | Medium |
| BLACK | 3–4 | 1–2 | 3 | 4–5 | 4 | 3–4 | Dark |
| GREEN | 4 | 2–3 | 3 | 4–5 | 3–4 | 3 | Medium |
| Commercial Pigment (30–35% Conc.) | | | | | | | |
| RED | 3 | 2 | 2–3 | 3 | 2–3 | 2–3 | Medium |
| BLUE | 2 | 2 | 2–3 | 3 | 2 | 2 | Dark |
| BLACK | 2 | 3 | 4 | 3 | 4 | 2 | Light |
| GREEN | 2–3 | 3 | 4 | 3 | 3 | 2 | Dark |
| Anionic Pigment Dispersion (15–20% Conc.) | | | | | | | |
| RED F4R | 3–4 | 4 | 4–5 | 2–3 | 4 | 3–4 | Light |
| BLUE BGID | 4 | 4 | 4–5 | 2–3 | 3 | 3 | Light |
| BLACK | 4 | 4 | 5 | 2–3 | 4 | 2–3 | Light |
| GREEN | 3 | 4–5 | 4–5 | 2–3 | 3–4 | 3–4 | Medium |

The rating 1 to 5 is given with 1 representing poor and 5 representing excellent.

Table V again shows the superiority of the padding process of the invention using cationic pigment dispersions.

Many modifications and other embodiments of the invention will come to mind to one skilled in the art, to which this invention pertains, having the benefit of the teachings presented in the foregoing description and the associated drawings. Therefore, it is to be understood that the invention is not to be limited to the specific embodiments disclosed and that modifications and other embodiments are intended to be included within the scope of the appended claims.

That which is claimed:

1. A method for dyeing an anionic textile material comprising the steps of:

a) applying a film-forming polymer and a cationic pigment dispersion comprising at least one pigment and at least one cationic dispersant to the surface of an anionic textile material;

b) drying the textile material; and c) curing the film-forming polymer to form a pigment-dyed textile material.

2. The method according to claim 1, wherein said applying step comprises padding the textile material with a bath comprising the film-forming polymer and the cationic pigment dispersion, said film-forming polymer having a positive or neutral charge.

3. A method for dyeing an anionic textile material comprising the steps of:

a) padding the textile material with a first bath containing a film-forming polymer;

b) drying the textile material;

c) padding the textile material with a second bath containing a cationic pigment dispersion comprising at least one pigment and at least one cationic dispersant;

d) drying the textile material; and e) curing the film-forming polymer to form a pigment-dyed textile material.

4. A method for dyeing an anionic textile material comprising the steps of:

a) padding the textile material with a first bath containing a cationic pigment dispersion comprising at least one pigment and at least one cationic dispersant;

b) drying the textile material;

c) padding the textile material with a second bath containing a film-forming polymer;

d) drying the textile material; and e) curing the film-forming polymer to form a pigment-dyed textile material.

5. The method according to claim 1, wherein said applying step comprises applying the film-forming polymer and the cationic pigment dispersion to the surface of a cellulosic textile material.

6. The method according to claim 5, wherein said applying step comprises applying the film-forming polymer and the cationic pigment dispersion to the surface of a cellulosic material including fibers selected from the group consisting of cotton, rayon, and solvent spun cellulose fibers, and blends thereof.

7. The method according to claim 6, wherein said applying step comprises applying the film-forming polymer and the cationic pigment dispersion to the surface of a cellulosic material comprising a blend of cellulosic fibers and non-cellulosic fibers.

8. The method according to claim 1, further comprising the step of wetting the textile material prior to said applying step.

9. The method according to claim 1, wherein said applying step further comprises applying at least one additive selected from the group consisting of wetting agents, cationic or nonionic surface active agents, defoamers, solvents, biocides, and fungicides, to the surface of the textile material.

10. The method according to claim 1, wherein said drying step and said curing step are performed in a single process step.

11. The method according to claim 1, wherein said drying step and said curing step occur at a temperature between room temperature and 300° C.

12. A method for dyeing an anionic textile material comprising the steps of:

a) applying a film-forming polymer and a cationic pigment dispersion comprising at least one pigment and at least one cationic dispersant to the surface of an anionic textile material;

b) drying the textile material; and c) curing the film-forming polymer to form a pigment-dyed textile material;

wherein said drying step and said curing step occur at a temperature between 100° C. to 150° C.

13. The method according to claim 1, wherein said applying step comprises a cationic pigment dispersion further comprising at least one nonionic dispersant.

14. The method according to claim 1, wherein the applying step comprises a cationic dispersant comprising a monomeric or polymeric compound including at least one cationic group selected from the group consisting of tertiary amines, quaternary amines, sulfonium moieties and phosphonium moieties.

15. A method for dyeing an anionic textile material comprising the steps of:

a) applying a cationic film-forming polymer that includes at least one cationic group selected from the group consisting of tertiary amines, quaternary amines, sulfonium moieties and phosphonium moieties and a cationic pigment dispersion comprising at least one pigment and at least one cationic dispersant to the surface of an anionic textile material;

b) drying the textile material; and c) curing the film-forming polymer to form a pigment-dyed textile material.

16. The method according to claim 1, wherein said applying step comprises an anionic or non-ionic film-forming polymer.

17. The method according to claim 1, wherein said applying step comprises applying the film-forming polymer and the cationic pigment dispersion to the surface of the textile material in one or more padding steps in a mangle having a wet pick-up ranging from 10% to 300%.

18. The method according to claim 1, wherein said applying step comprises applying the film-forming polymer and the cationic pigment dispersion to the surface of the textile material in one or more padding steps at a bath temperature between 0° C. and 100° C.

19. A pigment-dyed textile material prepared according to the method of claim 1.

20. A method of dyeing cellulosic materials comprising the steps of padding a cellulosic material with a bath comprising water, at least one cationic pigment dispersion, and at least one cationic or neutrally-charged binder; and drying and curing the padded cellulosic material at a temperature between 100° C. to 150° C.

21. A method of dyeing cellulosic materials comprising the steps of padding a cellulosic material with a bath comprising water and at least one cationic pigment dispersion, drying the cellulosic material at a temperature between 100° C. to 150° C., padding the cellulosic material with a bath comprising at least one binder having a positive, negative or neutral charge, and drying and curing the padded cellulosic material at a temperature between 100° C. to 150° C.

22. A method of dyeing cellulosic materials comprising the steps of padding a cellulosic material with a bath comprising at least one binder having a positive, negative or neutral charge, drying the cellulosic material at a temperature between 100° C. to 150° C., padding the cellulosic material with a bath comprising water and at least one cationic pigment dispersion, and drying and curing the padded cellulosic material at a temperature between 100° C. to 150° C.

23. A method of dyeing anionic textile material comprising the steps of:

a) padding an anionic textile material with a bath that includes a cationic pigment dispersion comprising at least one pigment and at least one cationic dispersant;

b) padding the anionic textile material with a bath that includes a binder;

c) drying the textile material; and d) curing the textile material to form a pigment-dyed textile material.

24. The method according to claim 23, wherein said padding steps (a) and (b) are performed simultaneously.

25. A method of dyeing anionic textile material comprising the steps of:

a) padding an anionic textile material with a bath that includes a cationic pigment dispersion comprising at least one pigment and at least one cationic dispersant;

b) padding the anionic textile material with a bath that includes a binder;

c) drying the textile material; and d) curing the textile material to form a pigment-dyed textile material;

wherein said padding step (a) is performed before said padding step (b).

26. The method according to claim 25, further comprising the additional step of drying the anionic textile after said padding step (a).

27. A method of dyeing anionic textile material comprising the steps of:

a) padding an anionic textile material with a bath that includes a cationic pigment dispersion comprising at least one pigment and at least one cationic dispersant;

b) padding the anionic textile material with a bath that includes a binder;

c) drying the textile material; and d) curing the textile material to form a pigment-dyed textile material;

wherein said padding step (b) is performed before said padding step (a).

28. The method according to claim 27, further comprising the additional step of drying the anionic textile after said padding step (b).

29. The method according to claim 1, wherein said applying step comprises applying a cationic pigment dispersion comprising at least one anionic pigment.

* * * * *